US007286025B2

(12) United States Patent
Endou et al.

(10) Patent No.: US 7,286,025 B2
(45) Date of Patent: Oct. 23, 2007

(54) CIRCULATOR ELEMENT

(75) Inventors: Kenji Endou, Tokyo (JP); Takahide Kurahashi, Tokyo (JP); Sakae Henmi, Tokyo (JP); Hidenori Ohata, Tokyo (JP)

(73) Assignee: TDK Corporation, Tokyo (JP)

( * ) Notice: Subject to any disclaimer, the term of this patent is extended or adjusted under 35 U.S.C. 154(b) by 170 days.

(21) Appl. No.: 11/175,930

(22) Filed: Jul. 6, 2005

(65) Prior Publication Data

US 2006/0006956 A1 Jan. 12, 2006

(30) Foreign Application Priority Data

Jul. 6, 2004 (JP) ..... 2004-198826

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,317,010 B1 * 11/2001 Butland et al. ..... 333/1.1

FOREIGN PATENT DOCUMENTS

| | | |
|---|---|---|
| JP | 02-113503 | 4/1990 |
| JP | 10-149910 | 6/1998 |
| JP | 11-273928 | 10/1999 |
| JP | 11-283821 | 10/1999 |
| JP | 2002-330003 | 11/2002 |
| JP | 2004-075503 | 3/2004 |
| JP | 2004-172827 | 6/2004 |

* cited by examiner

*Primary Examiner*—Stephen E. Jones
(74) *Attorney, Agent, or Firm*—Hogan & Hartson LLP

(57) ABSTRACT

A technique for improving a circulator element for its temperature characteristic is provided. A circulator element including a garnet type ferrite material, and a permanent magnet for applying a direct-current magnetic field to the garnet type ferrite material, wherein S11 represents the saturation magnetization of said garnet type ferrite material at a temperature T1, S12 represents one at a temperature T2, and S13 represents one at a temperature T3; and S21 represents the saturation magnetization of said permanent magnet at a temperature T1, S22 represents one at a temperature T2, and S23 represents one at a temperature T3, where T1<T2<T3, and the saturation magnetizations S11, S12, S13, S21, S22 and S23 are relative values providing that the saturation magnetizations at the temperature T2 is 1, and wherein the relations $|(S12-S11)/(T2-T1)|<|(S22-S21)/(T2-T1)|$ and $|(S13-S12)/(T3-T2)|>|(S23-S22)/(T3-T2)|$ are satisfied.

15 Claims, 4 Drawing Sheets

CIRCULATOR ELEMENT

BACKGROUND OF THE INVENTION

1. Field of the Invention

The present invention relates to a circulator element such as a lumped element isolator or circulator which is used in a high-frequency circuit or the like.

2. Description of the Related Art

Many of cellular phones that are currently used are digital cellular phones. Many of digital cellular phones that are used in Japan employ a PSK (phase modulation) system. In the PSK system digital cellular phone, a linear power amplification circuit is provided at the rear of a transmission circuit, and a transmission antenna is provided at the rear of the power amplification circuit.

The transmission antenna provided in the cellular phone has its impedance significantly changed according to positional relations with hands and a head, and other usage states, and therefore mismatching of impedance occurs between the transmission antenna and the power amplification circuit provided at the front of the transmission antenna. As a result, part of a signal output from the power amplification circuit to the transmission antenna becomes a reflected wave, causing the signal of the power amplification circuit to be distorted. Because the linear power amplification circuit is vulnerable to distortion of the signal, demodulation of the signal becomes difficult if the signal is considerably distorted.

As a measure for avoiding this problem, the conventional cellular phone comprises an isolator between the transmission antenna and the power amplification circuit. The isolator is a circulator element, and a signal input from the power amplification circuit is output to the transmission antenna, but a signal input from the transmission antenna is not output to the power amplification circuit. As a result, distortion of the signal of the power amplification circuit by the reflected wave from the transmission antenna is inhibited.

This type of isolator generally includes at least a magnetic rotator providing a irreversible characteristic, a permanent magnet for applying a direct-current magnetic field to the magnetic rotator, a central conductor placed between the magnetic rotator and the permanent magnet, a capacity substrate for a parallel resonance capacity, a yoke for improving efficiency of the direct-current magnetic field to the magnetic rotator. For the magnetic rotator, YIG (yttrium-iron-garnet) based ferrites, specifically garnet type ferrite materials prepared by adding various kinds of elements to $Y_3Fe_5O_{12}$ with $Y_3Fe_5O_{12}$ as a basic composition, are usually used. For the permanent magnet for application of a direct-current magnetic field, ferrite magnets are used, and for the capacity substrate, condensers using ceramics for high frequencies having a temperature characteristic of dielectric constant of near 0, glass epoxy resins or other resins developed for high frequencies or the like are used.

The reason why YIG is used for high frequency circuit components such as a circulator and an isolator is that a saturation magnetization ($4\pi Ms$) suitable for the circuit and a temperature characteristic thereof can be set, and a magnetic resonance half line width ($\Delta H$) representing a magnetic loss and a dielectric loss (tan $\delta$) representing an electric loss are small. Indeed, the magnitudes of the magnetic resonance half line width ($\Delta H$) and the dielectric loss (tan $\delta$) have significant influences on device performance of the circulator and the isolator, and therefore for obtaining a smaller magnetic resonance half line width ($\Delta H$) and dielectric loss (tan $\delta$), studies have been conducted on their compositions, added elements and substituent elements (e.g. Japanese Patent Publication No. 4-74842 (Patent Document 1) and Japanese Patent Laid-Open No. 11-273928 (Patent Document 2)).

[Patent Document 1] Japanese Patent Publication No. 4-74842

[Patent Document 2] Japanese Patent Laid-Open No. 11-273928

However, in the conventional garnet type ferrite material, the range of compositions for a satisfactory magnetic resonance half line width ($\Delta H$) and dielectric loss (tan $\delta$) is so small that the magnetic resonance half line width ($\Delta H$) and the dielectric loss (tan $\delta$) are considerably degraded even with a very small variation in composition, and therefore there is a problem in terms of commercialization, thus making it difficult to realize a circulator element such as an isolator excellent in both insertion loss and temperature characteristic.

There are cases where characteristics as a circulator element such as an isolator cannot be satisfied by merely adjusting characteristics of the garnet type ferrite material. Particularly, even if the temperature characteristic of the garnet type ferrite material itself is improved, the temperature characteristic as the circulator element is not necessarily improved.

Thus, the object of the present invention is to provide a technique for improving a circulator element for its temperature characteristic.

SUMMARY OF THE INVENTION

The present inventors have found that a circulator element for its temperature characteristic can be improved by combining a garnet type ferrite material and a permanent magnet having a predetermined relation in temperature characteristic of saturation magnetization. That is, the circulator element of the present invention comprises a garnet type ferrite material, a permanent magnet for applying a direct-current magnetic field to the garnet type ferrite material, wherein S11 represents the saturation magnetization of the garnet type ferrite material at a temperature T1, S12 represents one at a temperature T2 and S13 represents one a temperature T3, and S21 represents the saturation magnetization of the permanent magnet at the temperature T1, S22 represents one at the temperature T2 and S23 represents one at the temperature T3; where T1<T2<T3, and saturation magnetizations S11, S12, S13, S21, S22 and S23 are relative values providing that the saturation magnetization at the temperature T2 is 1, the requirements of $|(S12-S11)/(T2-T1)|<|(S22-S21)/(T2-T1)|$ and $|(S13-S12)/(T3-T2)|>|(S23-S22)/(T3-T2)|$ are met.

In the circulator element of the present invention, T1, T2 and T3 can satisfy the requirements of T1=−35° C., T2=25° C. and T3=85° C. According to the circulator element of the present invention, the temperature characteristic of the center frequency at a temperature of −35° C. to 85° C. can be 0.01%/° C. or less. According to the circulator element of the present invention, where the center frequency at the temperature T3 is taken as a reference, and a frequency higher than the reference is a positive number and a frequency lower than the reference is a negative number, it is preferable that one of the center frequency at the temperature T2 and the center frequency at the temperature T1 is a positive number and the other is a negative number.

Further preferably, in the circulator element of the present invention, the requirement of $|F3-F2|\leqq|F2-F1|$ is met where the center frequency at a temperature T1 is F1, the center frequency at a temperature T2 is F2 and the center frequency at a temperature T3 is F3.

The permanent magnet for use in the present invention preferably has a composition expressed by $(Sr_{1-\alpha}La_{\alpha})(Fe_{12-\beta}Co_{\gamma})_{\gamma}O_{19}$ (wherein $0.1 \leqq \alpha \leqq 0.4$, $0.1 \leqq \beta \leqq 0.4$, $0.8 \leqq \gamma \leqq 1.1$). The permanent magnet having this composition has high magnetic properties, and therefore allows the circulator element to be downsized.

The garnet type ferrite material corresponding to the above permanent magnet preferably has a composition expressed by $(Y_wGd_xCa_q)(Fe_{8-w-x-y-3z}In_yV_z)O_{12}$ (wherein w, x, q, y and z each satisfy the inequalities of $3.01 \leqq w+x+q \leqq 3.03$, $0.25 \leqq x \leqq 0.55$, $0.02 \leqq y \leqq 0.12$, $0<z \leqq 0.15$, $1.8<q/z \leqq 2.0$). The garnet type ferrite material having this composition can satisfy the relation of the temperature characteristic of saturation magnetization described above for the permanent magnet having the above-mentioned composition.

The above described circulator element comprising a garnet type ferrite material and a permanent magnet for applying a direct-current magnetic field to the garnet type ferrite material has a larger gradient in a temperature characteristic curve of saturation magnetization of the permanent magnet than a gradient in a temperature characteristic curve of saturation magnetization of the garnet type ferrite material at a temperature range between T1 and T2. Likewise, the above described circulator element has a smaller gradient in a temperature characteristic curve of saturation magnetization of the permanent magnet than a gradient in a temperature characteristic curve of saturation magnetization of the garnet type ferrite material at a temperature range between T2 and T3. Thus, the present invention also provides a circulator element including a first region where the gradient in the temperature characteristic curve of saturation magnetization of the permanent magnet is larger than the gradient in the temperature characteristic curve of saturation magnetization of the garnet type ferrite material, and a second region where the gradient in the temperature characteristic curve of saturation magnetization of the permanent magnet is smaller than the gradient in the temperature characteristic curve of saturation magnetization of the garnet type ferrite material. The second region is located in a temperature range higher than that of the first region.

In this circulator element, the first region and the second region can meet at near an ambient temperature. The "near an ambient temperature" in the present invention includes at least temperatures of 10 to 30° C.

The permanent magnet for applying a direct-current magnetic field to the garnet type ferrite material has a composition expressed by the general formula (1): $(Sr_{1-\alpha}La_{\alpha})(Fe_{12-\beta}Co_{\beta})_{\gamma}O_{19}$ (wherein $0.1 \leqq \alpha \leqq 0.4$, $0.1 \leqq \beta \leqq 0.4$, $0.8 \leqq \gamma \leqq 1.1$), thereby contributing to the downsizing of the circulator element, as described above. Also, the permanent magnet having this composition is combined with the garnet type ferrite material having a composition expressed by the general formula (2): $(Y_wGd_xCa_q)(Fe_{8-w-x-y-3z}In_yV_z)O_{12}$ (wherein w, x, q, y and z each satisfy the relations of $3.01 \leqq w+x+q \leqq 3.03$, $0.25 \leqq x \leqq 0.55$, $0.02 \leqq y \leqq 0.12$, $0<z \leqq 0.15$, $1.8<q/z \leqq 2.0$), whereby the temperature characteristic as the circulator element is effectively improved, as described above. Thus, the present invention provides a circulator element comprising a garnet type ferrite material having a composition expressed by the general formula (1): $(Y_wGd_xCa_q)(Fe_{8-w-x-y-3z}In_yV_z)O_{12}$ (wherein w, x, q, y and z each satisfy the inequalities of $3.01 \leqq w+x+q \leqq 3.03$, $0.25 \leqq x \leqq 0.55$, $0.02 \leqq y \leqq 0.12$, $0<z \leqq 0.15$, $1.8<q/z \leqq 2.0$) and a permanent magnet having a composition expressed by the general formula (2): $(Sr_{1-\alpha}La_{\alpha})(Fe_{12-\beta}Co_{\beta})_{\gamma}O_{19}$ ($0.1 \leqq \alpha \leqq 0.4$, $0.1 \leqq \beta \leqq 0.4$, $0.8 \leqq \gamma \leqq 1.1$) and applying a direct-current magnetic field to the garnet type ferrite material.

As described above, according to the present invention, a garnet type ferrite material and a permanent magnet having a predetermined relation in temperature characteristic of saturation magnetization are combined, whereby the temperature characteristic of a circulator element can be improved. According to the present invention, a permanent magnet having a specific composition and having high magnetic properties is used, thereby making it possible to contribute to the downsizing of the circulator element.

DETAILED DESCRIPTION OF THE PREFERRED EMBODIMENTS

A circulator element of the present invention will be described below using a lumped element isolator (hereinafter referred to as isolator) as an example.

<General Configuration of Isolator>

Figure 1:
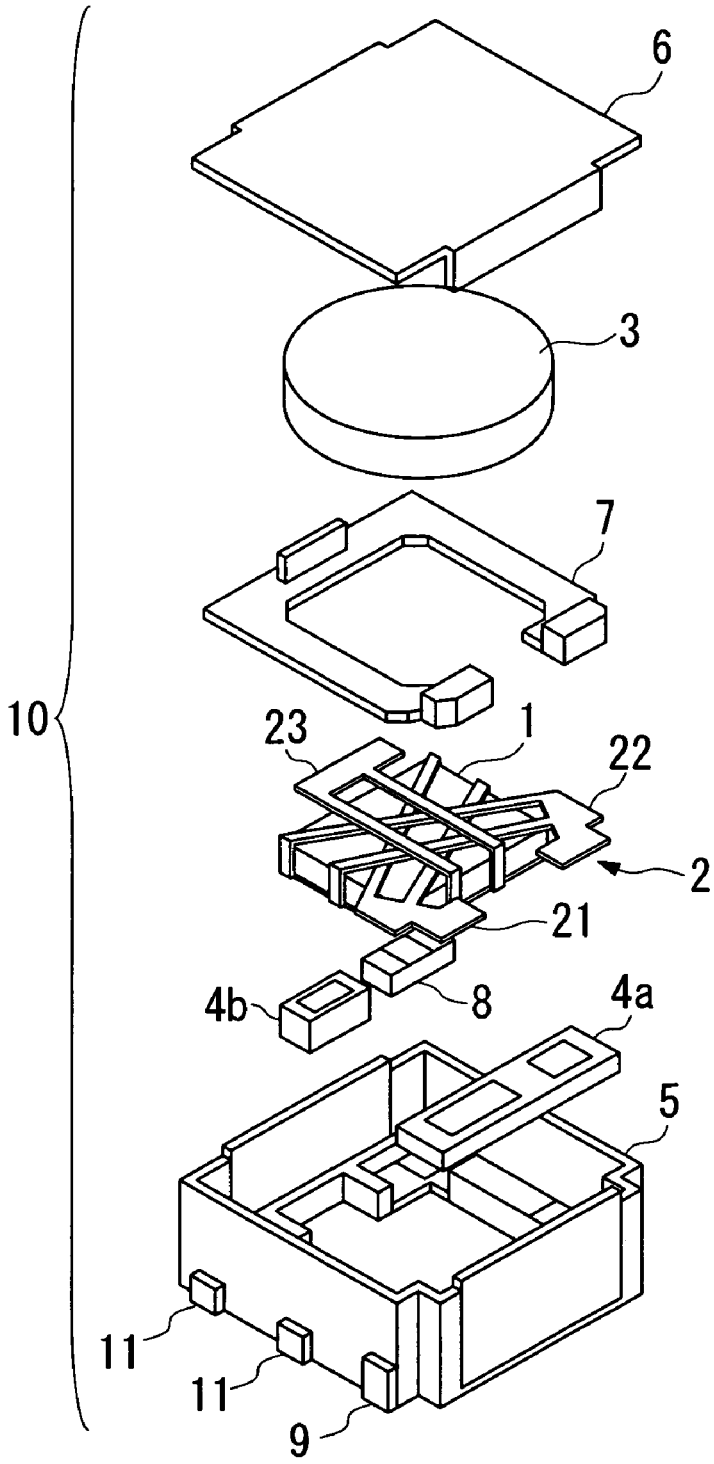
FIG. 1 is an exploded perspective view schematically showing a general configuration and an assembly order of a lumped element isolator according to the present invention.
Figure 2:
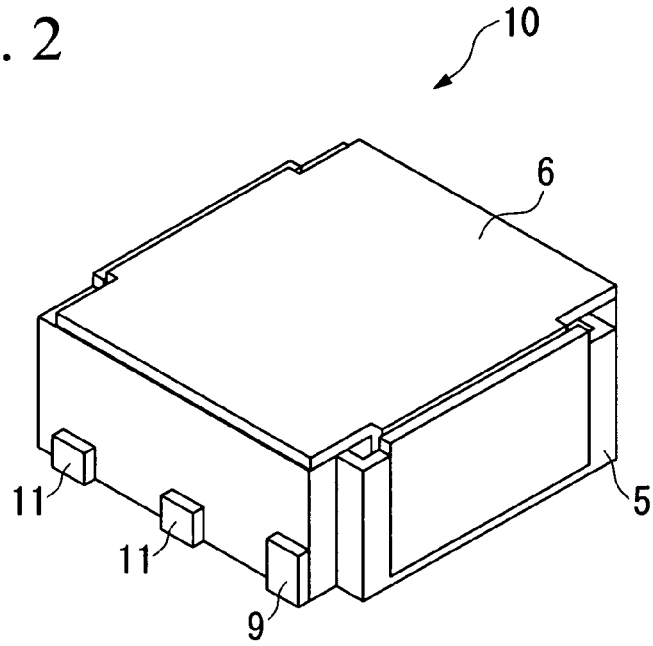
FIG. 2 is a perspective view showing an assembly state of the lumped element isolator according to the present invention.

FIG. 1 is an exploded perspective view schematically showing a general configuration and an assembly order of an isolator 10 according to the present invention, and FIG. 2 is a perspective view showing an external appearance of the lumped element isolator 10 according to the present invention.

In FIGS. 1 and 2, the isolator 10 includes a garnet type ferrite material 1 described later, a central conductor 2 mounted on the garnet type ferrite material 1, a cylindrical permanent magnet 3, capacity substrates 4*a* and 4*b*, and a dummy load 8. The permanent magnet 3 made from a sintered body described later applies a direct-current magnetic field to the garnet type ferrite material 1. The central conductor 2 comprises strip lines 21, 22 and 23, and is placed between the garnet type ferrite material 1 and the permanent magnet 3. The central conductor 2 is made from, for example, a copper foil.

The isolator 10 has a case 5 and a cover 6. The case 5 contains the garnet type ferrite material 1, the central conductor 2, the permanent magnet 3 and the capacity substrates 4*a* and 4*b*. An input/output terminal 9 is provided on the outer periphery of the case 5. The cover 6 covers the upper part of an opening of the case 5 containing the garnet type ferrite material 1 and so on. The case 5 and the cover 6 include a soft magnetic metal such as iron, and function as a yoke. This yoke performs a function such that a direct-current magnetic field is effectively applied from the permanent magnet 3 to the garnet type ferrite material 1.

Spacer 7 places the garnet type ferrite material 1, the central conductor 2 and the permanent magnet 3 at predetermined positions with the garnet type ferrite material 1 and so on contained in the case 5. The spacer 7 may be made from, for example, a liquid crystal polymer.

The capacity substrates 4*a* and 4*b* are made from an inorganic or organic dielectric material. The strip lines 21 and 22 are placed on the upper surface of the capacity substrate 4*a*, the strip line 23 is placed on the upper surface of the capacity substrate 4*b*, and the strip lines are each attached by means of soldering or the like. The capacity substrates 4*a* and 4*b* are made from a dielectric ceramic provided with a conductor pattern.

The dummy load 8 has a ruthenium oxide based resistive film, and is provided with electrodes at both ends, and one of the electrodes is electrically connected to the strip line 23, and the other electrode is electrically connected to a GND terminal 11 of the case 5.

≦Garnet Type Ferrite Material>

The garnet type ferrite material 1 will now be described.

The garnet type ferrite material 1 is made from a garnet type ferrite material expressed by the general formula (1): $(Y_w Gd_x Ca_q)(Fe_{8-w-x-y-3z} In_y V_z)O_{12}$ (wherein w, x, q, y and z each satisfy the inequalities of $3.01 \leqq w+x+q \leqq 3.03$, $0.25 \leqq x \leqq 0.55$, $0.02 \leqq y \leqq 0.12$, $0 < z \leqq 0.15$, $1.8 < q/z \leqq 2.0$). The garnet type ferrite material is a material wherein Y of YIG ($Y_3Fe_5O_{12}$) is substituted with Gd and Ca and Fe is substituted with In and V. Substitution of Y with Gd has an effect of improving the temperature characteristic of saturation magnetization. Substitution of Fe with In has an effect of reducing a magnetic loss. Further, Ca and V have an effect of reducing voids of crystal boundaries and growing crystals. For example, this garnet type ferrite material allows a saturation magnetization ($4\pi Ms$) to be arbitrarily set within the range of 1400 to 1800 G, a temperature characteristic of saturation magnetization to be arbitrarily set within the range of −0.10 to −0.25%/° C., and a magnetic resonance half line width ($\Delta H$) and a dielectric loss (tan $\delta$) to be reduced. The substitution of Fe with V is not necessary, therefore z may be zero. In this case, q is also zero. In addition to the above elements, elements such as, for example, Zr and Sc have been found to have an effect similar to that of In. These elements may be contained in an amount of about 0.01 Atm/mol. Although the composition ratio changes, the magnetic loss can be reduced by Zr in place of In to obtain a material somewhat improved in temperature characteristic and loss.

In the above general formula (1), if x (Gd) is less than 0.25, the effect of improving the temperature characteristic is not exhibited, and if x is more than 0.55, the temperature characteristic of the circulator element is inverted, resulting in a degradation in insertion loss. Thus, in the present invention, x is in the range of $0.25 \leqq x \leqq 0.55$. Preferable x is in the range of $0.3 \leqq x \leqq 0.5$, and further preferable x is in the range of $0.32 \leqq x \leqq 0.48$.

In the above general formula (1), if y(In) is less than 0.02, the effect of reducing the magnetic loss is not exhibited, and if y is more than 0.12, the magnetic improvement effect is saturated, and further the temperature characteristic improvement effect by Gd is reduced. Thus, in the present invention, y is in the range of $0.02 \leqq y \leqq 0.12$. Preferable y is in the range of $0.03 \leqq y \leqq 0.10$, and further preferable y is in the range of $0.04 \leqq y \leqq 0.09$.

In the present invention, the ratio of Ca:V=2:1 is most desirable for charge compensation, but the present invention permits the range of $1.8 \leqq Ca(q)/V(z) \leqq 2.0$. In the above described general formula (1), if Ca is more than 0.3 (V is more than 0.15), the saturation magnetization decreases to cause a degradation in loss of the circulator element. Thus, in the present invention, z is in the range of $0 < z \leqq 0.15$ when Fe is substituted with V. Preferable z is in the range of $0.02 \leqq z \leqq 0.12$, and further preferable z is in the range of $0.04 \leqq z \leqq 0.10$.

In the present invention, w+x+q showing the amount of c site, a sub-lattice of the garnet type ferrite material 1 mainly composed of Y is in the range of $3.01 \leqq w+x+q \leqq 3.03$. If the w+x+q is less than 3.01, the saturation magnetization decreases. If further extremely, w+x+q is less than 3, a liquid phase is generated, and thus a normal sintered body cannot be obtained. If w+x+q is more than 3.03, a different phase is generated, the saturation magnetization thus decreases, the coercive force increases, and the loss of the circulator element increases. Preferable w+x+q is in the range of 3.015 to 3.025. When Fe is not substituted with V, i.e. z is zero, q is also zero. In this case, wand x are in the range of $3.01 \leqq w+x \leqq 3.03$, preferably in the range of $3.015 \leqq w+x \leqq 3.025$.

The garnet type ferrite material 1 according to the present invention can be produced in the following way.

For example, a $Y_2O_3$ powder, a $Gd_2O_3$ powder, a $CaCO_3$ powder, a $Fe_2O_3$ powder, an $In_2O_3$ powder and $Y_2O_5$ powder are used as a raw material, and these powders are weighed to give a composition expressed by the above general formula (1), and then mixed. For the raw materials, compounds of such metal elements that can be converted to the oxides by sintering, for example, carbonates, hydroxides, oxalates and the like may be also used. The mean particle size of the raw material powder is preferably in the range of about 0.5 to 10 μm. Then, the mixed powder is calcined at 1100 to 1300° C. for 1 to 10 hours. The calcined powder is milled by a ball mill or the like, so that the mean particle size is preferably in the range of 1 to 10 μm. The obtained calcined powder is granulated using, for example, PVA (polyvinyl alcohol), then compacted into a predetermined shape, and then sintered at a temperature of 1400 to 1600° C. for 1 to 10 hours, whereby the garnet type ferrite material according to the present invention can be obtained.

≦Permanent Magnet>

The permanent magnet 3 will now be described.

The permanent magnet 3 for use in the present invention has a composition expressed by the general formula (2): $(Sr_{1-\alpha} La_\alpha)(Fe_{12-\beta} Co_\beta)_\gamma O_{19}$ (wherein $0.1 \leqq \alpha \leqq 0.4$, $0.1 \leqq \beta \leqq 0.4$, $0.8 \leqq \gamma \leqq 1.1$), and is made from a sintered body having as a main phase a hexagonal ferrite, preferably a hexagonal magnetoplumbite (M type) ferrite.

In the above general formula (2), if $\alpha$ is too small, i.e. the amount of La is too small, the content of Co in the hexagonal ferrite cannot be increased, and the saturation magnetization improvement effect and/or anisotropic magnetic field improvement effect becomes insufficient. If $\alpha$ is too large, La cannot be substitutionally contained in the hexagonal ferrite, and for example, an orthoferrite containing La is produced to decrease the saturation magnetization.

In the above general formula (2), if $\beta$ is too small, the saturation magnetization improvement effect and/or anisotropic magnetic field improvement effect becomes insufficient. If β is too large, Co cannot be substitutionally contained in the hexagonal ferrite. Even in the range where Co can be substitutionally contained, the anisotropy constant ($K_1$) and the anisotropic magnetic field ($H_A$) are significantly degraded.

In the above general formula (2), if γ is too small, a nonmagnetic phase containing Sr and La increases, and therefore the saturation magnetization decreases. If γ is too large, an α-$Fe_2O_3$ phase or a nonmagnetic spinel ferrite phase containing Co increases, and therefore the saturation magnetization decreases.

The permanent magnet 3 can be produced in the following way.

As raw material powders, a $Fe_2O_3$ powder, a $SrCO_3$ powder, a $Co_3O_4$ powder, a CoO powder and a $La_2O_3$ powder are weighed to give a composition expressed by the above general formula (2), and mixed, and the resultant mixture is calcined. The calcination may be carried out in air, for example at a temperature of 1000 to 1350° C. for 1 second to 10 hours, particularly for about 1 second to 3 hours.

Because the calcined material is generally granular, dry milling is preferably first carried out for milling or pulverizing thereof. The dry milling also has an effect of introducing a crystal strain into ferrite particles to reduce a coercive force. Owing to the reduction in coercive force, coagulation of particles is inhibited, and dispersibility is improved. By inhibition of coagulation of particles, the degree of orientation is improved. The crystal strain introduced into particles is released in a subsequent sintering step, and the coercive force is restored, whereby a permanent magnet can be provided. At the time of dry milling, $SiO_2$ and $CaCO_3$, which is changed into CaO through sintering, are usually added. $SiO_2$ and $CaCO_3$ may be partly added before sintering. Impurities and added Si and Ca are mostly segregated at grain boundaries and triple point areas, but partly captured in ferrite areas in particles (main phase). Particularly, Ca highly possibly enters a Sr site.

It is preferable that after dry milling, a slurry to be milled containing ferrite particles and water is prepared, and wet milling is carried out using the slurry.

After wet milling, the slurry to be milled is concentrated to prepare a slurry to be compacted. The concentration may be carried out by centrifugal separation, filter press or the like.

The slurry may be subjected to a dry compacting or a wet compacting, but for increasing the degree of orientation, wet compacting is preferable.

In a wet compacting step, a magnetic field is applied to the slurry to be compacted. The compacting pressure may be in the range of about 0.1 to 0.5 ton/$cm^2$, and the applied magnetic field may be in the range of about 5 to 15 kOe. In wet compacting, a nonaqueous dispersing medium may be used, or an aqueous dispersing medium may be used. If the nonaqueous dispersing medium is used, a surfactant such as, for example, oleic acid is added to an organic solvent such as toluene or xylene to form a dispersing medium. By using such a dispersing medium, a magnetic orientation degree as high as 98% at maximum can be obtained even if ferrite particles of submicron size hard to be dispersed are used. For the aqueous dispersing medium, dispersing media having various kinds of surfactants added in water may be used.

After the compacting step, the compact is heat-treated in air or nitrogen at a temperature of 100 to 500° C. to sufficiently decompose away the added dispersant. Then, in a sintering step, the compact is sintered in, for example, air for about 0.5 to 3 hours at a temperature of preferably 1150 to 1270° C., more preferably 1160 to 1240° C. to obtain an anisotropic ferrite sintered magnet.

The permanent magnet 3 obtained in this way can have a residual magnetic flux density (Br) of 4.2 kG or more, a coercive force (HcJ) of 4.1 kOe or more, and a maximum energy product (BH) max of 4.7 MGOe or more.

≦Temperature Characteristic>

Figure 3:
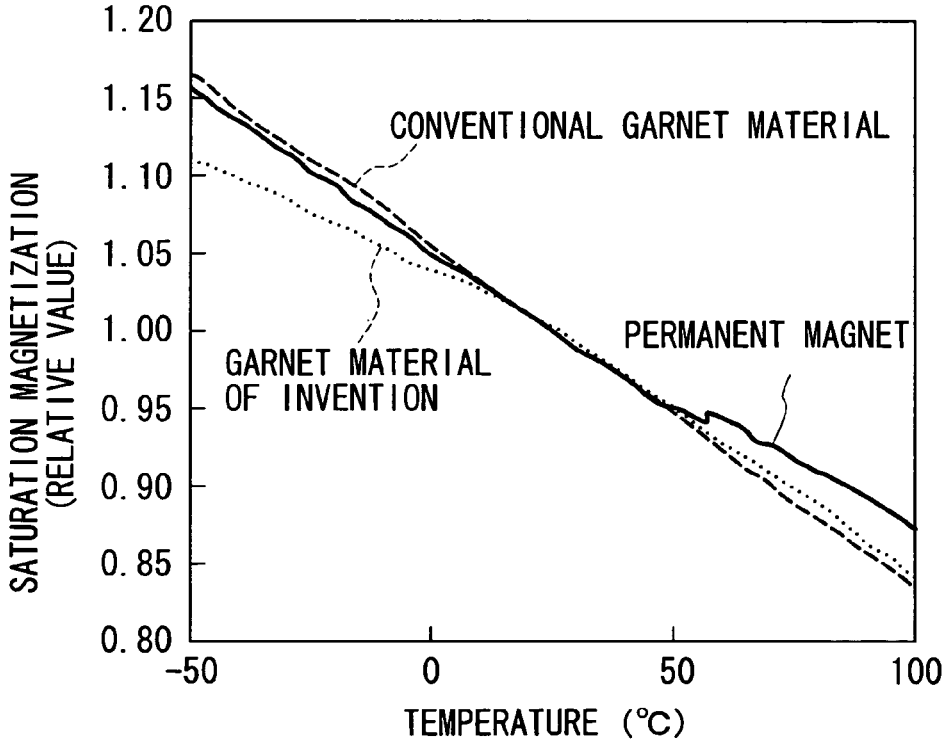
FIG. 3 is a graph showing the temperature characteristic of saturation magnetization of a permanent magnet for use in the present invention, a conventional garnet type ferrite material, and a garnet type ferrite material for use in the present invention, with relative values when the saturation magnetization at 25° C. is 1.

The present invention optimizes a relation between the temperature characteristic of saturation magnetization of the garnet type ferrite material 1 and the temperature characteristic of saturation magnetization of the permanent magnet 3 (hereinafter referred to simply as temperature characteristic in some cases) described above. A specific process of the optimization will be described based on FIG. 3. FIG. 3 is a graph showing the temperature characteristic of saturation magnetization of the permanent magnet 3 for use in the present invention, which applies a direct-current magnetic field to the isolator 10, the conventional garnet type ferrite material (conventional material) and the garnet type ferrite material 1 for use in the present invention, with relative values when the saturation magnetization at 25° C. is 1.

Compared with the temperature characteristic curve of the permanent magnet 3, the temperature characteristic curve of the conventional garnet type ferrite material has a larger gradient over the entire temperature range. In contrast to this, for the garnet type ferrite material 1 for use in the present invention, the gradient in the temperature characteristic curve is smaller than that of the ferrite magnet at low to an ambient temperatures, but is larger at ambient to high temperatures. Specifically, where S11 represents the saturation magnetization of the garnet type ferrite material 1 at a low temperature, S12 represents one at an ambient temperature, and S13 represents one at a high temperature, and S21 represents the saturation magnetization of the permanent magnet 3 at a low temperature, S22 represents one at an ambient temperature, and S23 represents one at a high temperature, the requirements of $$|(S12-S11)/(T2-T1)|<|(S22-S21)/(T2-T1)| \text{ and}$$

$$|(S13-S12)/(T3-T2)|>|(S23-S22)/(T3-T2)| \text{ are met.}$$

In this way, according to the present invention, a first region where the gradient in the temperature characteristic curve of the permanent magnet 3 is larger than the gradient in the temperature characteristic curve of the garnet type ferrite material 1, and a second region where the gradient in the temperature characteristic curve of the permanent magnet 3 is smaller than the gradient in the temperature characteristic curve of the garnet type ferrite material 1 are provided. The second region is located in a temperature range higher than that of the first region, and the first region and the second region meet at near an ambient temperature.

As seen from FIG. 3, in the conventional garnet type ferrite material, the saturation magnetization decreases at a higher rate than the permanent magnet 3 with elevation of temperature at a low temperature (−35° C.) to a high temperature (85° C.). Thus, in any region of this temperature range, the center frequency of the isolator 10 is shifted toward the higher frequency side with elevation of temperature (see FIG. 4).

However, in the garnet type ferrite material 1 according to the present invention, the saturation magnetization decreases at a rate closer to that of the permanent magnet 3 compared to the conventional garnet type ferrite material in the entire temperature range. When making a further close observation, the gradient with which the saturation magnetization decreases at a low temperature (−35° C.) to an ambient temperature (25° C.) is smaller than that of the permanent magnet 3. Therefore, in this temperature range, the center frequency of the isolator 10 is shifted toward the lower frequency side with elevation of temperature (see FIG. 5). However, at an ambient temperature (25° C.) to a high temperature (85° C.), the saturation magnetization of the garnet type ferrite material 1 according to the present invention starts to decrease with a gradually increased gradient compared to the gradient for the ferrite magnet. Therefore, in the temperature range of an ambient temperature (25° C.) to a high temperature, conversely, the center frequency of the isolator 10 starts to be gradually shifted toward the higher frequency side with elevation of temperature (see FIG. 5). Thus, the variable range of center frequency in the isolator 10 of the present invention with a change in temperature can be reduced to, for example, ¼ or less in the entire usage temperature range. In the garnet type ferrite material 1 according to the present invention, the gradient in the temperature characteristic curve in the usage temperature range is originally close to the gradient in the temperature characteristic curve of the permanent magnet 3, and therefore a frequency variation per 1° C. is smaller than that for the conventional garnet type ferrite material 1. The garnet type ferrite material 1 according to the present invention has a gradient in the temperature characteristic curve which is reversed with respect to the gradient in that of the permanent magnet 3 and near ambient temperature (25° C.), and therefore the center frequency varies in the same direction on the basis of an ambient temperature (25° C.) in both the range of an ambient temperature (25° C.) to a high temperature (85° C.) and range of an ambient temperature (25° C.) to a low temperature (−35° C.) (see FIG. 5).

By selecting the garnet type ferrite material and the permanent magnet as described above, a circulator element having an excellent temperature characteristic such that a change in center frequency associated with temperature can be 0.01%/° C. or less in a temperature range between −35° C. and 85° C. In addition, in the circulator element, the garnet type ferrite material has the composition described above, whereby the values of the magnetic resonance half line width (ΔH) and the dielectric loss (tan δ) can be reduced.

EXAMPLE 1

The present invention will be described below based on a specific example.

As raw materials, a $Y_2O_3$ powder, a $Fe_2O_3$ powder, a $Gd_2O_3$ powder, an $In_2O_3$ powder, a $V_2O_5$ powder and a $CaCO_3$ powder each having a purity of 99.9% or more were used. These powders were weighed so that sintered bodies had final compositions shown in Tables 1 and 2, wet mixed by a ball mill and dried. The mixture was calcined at 1100° C. for 4 hours, then wet milled by the ball mill and dried. The obtained calcined powder was granulated and compacted into a sample shape for measurement of each material characteristic, and sintered at a temperature of 1450 to 1500° C. for 6 hours to obtain a garnet type ferrite material.

Then, the permanent magnet according to the present invention was fabricated in the following way.

As raw materials, a $Fe_2O_3$ powder, a $SrCO_3$ powder, a mixture of $Co_3O_4$ powder and a CoO powder, and a $La_2O_3$ powder were prepared, and these powders were blended to give a composition of $(Sr_{0.81}La_{0.19})(Fe_{11.82}Co_{0.18})_1O_{19}$. Further, 0.2 wt % of $SiO_2$ powder and 0.15 wt % of $CaCO_3$ powder were added to the above raw material and mixed. The obtained mixture was milled by a wet attritor for 2 hours, dried, regulated, and then calcined in air at 1200° C. for 3 hours to obtain a granular calcined material.

To the calcined material were added 0.4 wt % Of $SiO_2$ powder and 1.25 wt % of $CaCO_3$ powder, and the calcined material was milled by a dry rod mill until the specific surface area of the calcined material was 7 $m^2/g$.

Then, the calcined powder was wet milled in the ball mill using xylene as a nonaqueous solvent and oleic acid as a surfactant. Oleic acid was added to the calcined powder in an amount of 1.3 wt %. The amount of the calcined powder in a slurry was 33 wt %. The milling was carried out until the specific surface area was in the range of 8 to 9 $m^2/g$.

Then, the milled slurry was conditioned by a centrifugal separator so that the concentration of the calcined powder in the slurry was about 85 wt %. The slurry was compacted into a cylindrical shape having a diameter of 30 mm and a height of 15 mm in a vertical magnetic field of about 13 kG while the solvent was removed from the slurry. The compacting pressure was 0.4 $ton/cm^2$.

Then, the obtained compact was heat-treated at a temperature of 100 to 300° C. to sufficiently remove oleic acid, then held in air at 1200° C. for 1 hour at rate of temperature rise of 5° C./minute and thereby sintered to obtain a ferrite permanent magnet.

The dielectric loss (tan δ) and the magnetic resonance half line width (ΔH) of the garnet type ferrite material obtained as described above were measured. The measurement of the dielectric loss (tan δ) was carried out at about 10 GHz using a perturbation method by a $TM_{010}$ cavity resonator for a cylindrical sample having a diameter of 1 mm and a length of 30 mm. The measurement of the magnetic resonance half line width (ΔH) was carried out at about 10 GHz using a $TE_{104}$ cavity resonator for a spherical sample having a diameter of 1 mm.

Figure 4:
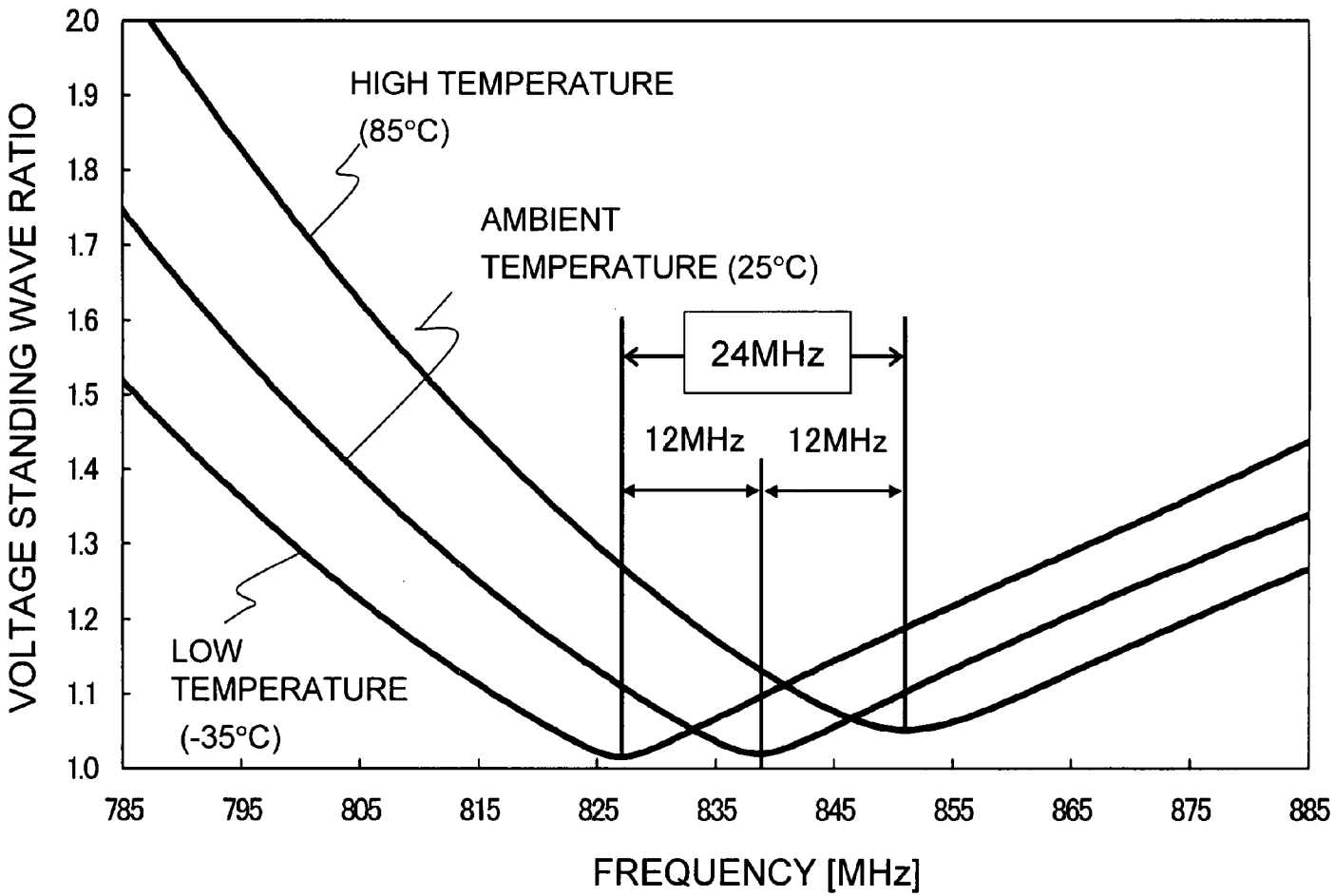
FIG. 4 is a graph showing measurement results of variation in center frequency with a change in temperature of the isolator using the garnet type ferrite material of sample No. 21.
Figure 5:
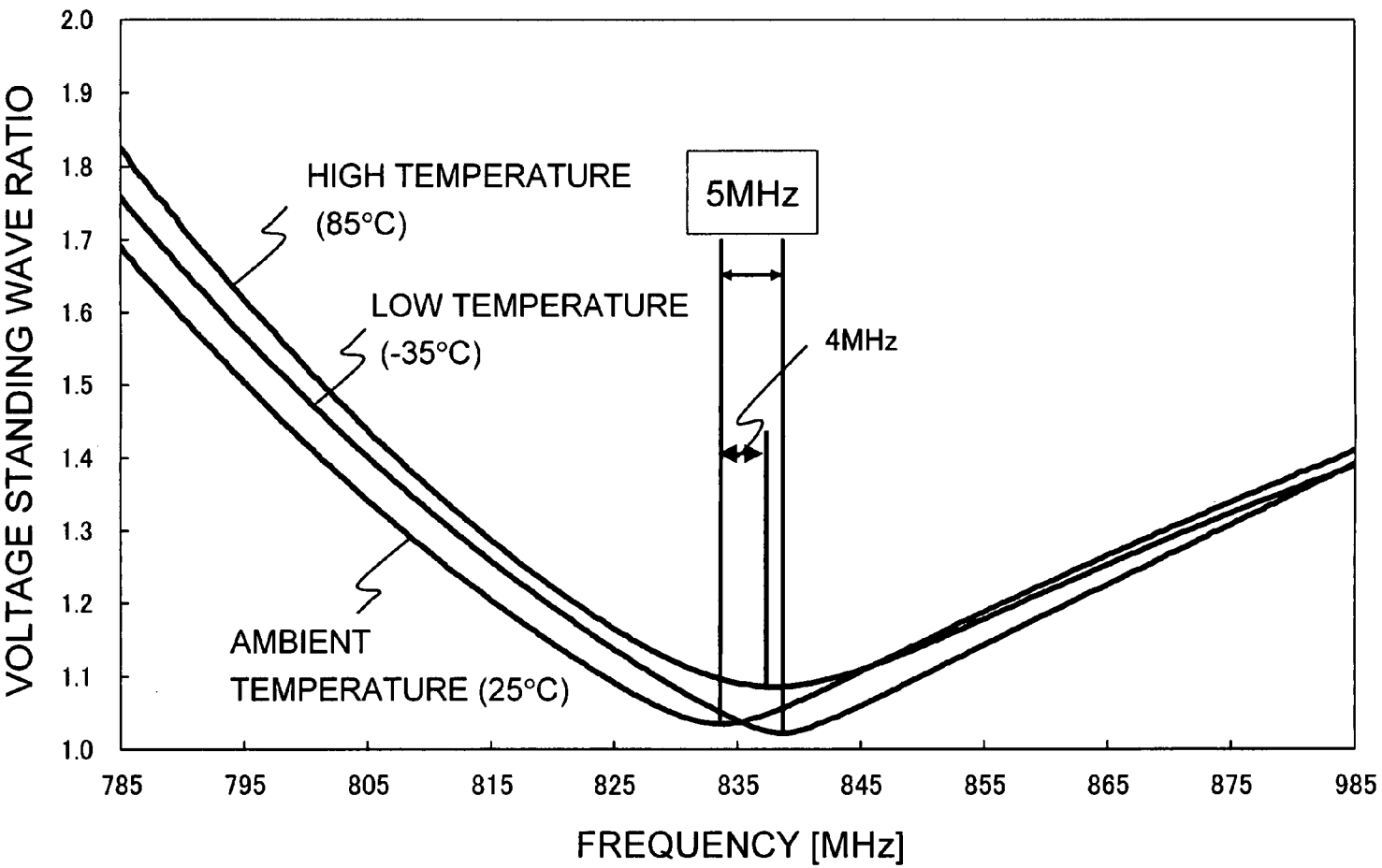
FIG. 5 is a graph showing measurement results of variation in center frequency with a change in temperature of the isolator using the garnet type ferrite material of sample No. 7.

The isolators described in the embodiment were fabricated using the above garnet type ferrite materials and the above ferrite permanent magnet, and their insertion loss and variation in center frequency with a change in temperature were measured. The fabricated isolator is of 4 mm square, and is intended to be used at a 900 MHz band. For the variation in center frequency with a change in temperature, the VSWR (voltage standing wave ratio) was measured at an ambient temperature (25° C.), a high temperature (85° C.) and a low temperature (−35° C.) to determine variation in center frequency (Δf1, Δf2, Δf) with a change in temperature. The results are shown in Tables 1 and 2. The measurement results of variation in center frequency with a change in temperature, in connection with the isolators using garnet type ferrite materials of sample No. 21 (comparative example) and sample No. 7 (invention) are shown in FIGS. 4 and 5, respectively.

TABLE 1

| Sample No. | Composition (atm/mol) Y (w) | Ca (q) | Gd (x) | Fe — | In (y) | V (z) | tan δ | Δ H (Oe) | Insertion loss (dB) | Δ f1: Low temp. to ambient temp. (MHz) | Δ f2: Ambient temp. to high temp. (MHz) | Δ f (MHz) |
|---|---|---|---|---|---|---|---|---|---|---|---|---|
| 1 | 2.55 | 0.12 | 0.35 | 4.9 | 0.02 | 0.06 | — | — | 0.45 | −6.5 | 2 | 6.5 |
| 2 | 2.55 | | 0.35 | 4.89 | 0.03 | | — | — | 0.43 | −7 | 2 | 7 |
| 3 | 2.55 | | 0.35 | 4.88 | 0.04 | | — | — | 0.47 | −8.5 | 0.5 | 8.5 |
| 4 | 2.55 | | 0.35 | 4.87 | 0.05 | | — | — | 0.44 | −3.5 | 5.5 | 5.5 |
| 5 | 2.5 | | 0.4 | 4.9 | 0.02 | | — | — | 0.47 | −6.5 | 0.5 | 6.5 |
| 6 | 2.5 | | 0.4 | 4.89 | 0.03 | | — | — | 0.47 | −6.5 | 3 | 6.5 |
| 7 | 2.5 | | 0.4 | 4.88 | 0.04 | | 0.0008 | 27 | 0.39 | −5 | 4 | 5 |
| 8 | 2.5 | | 0.4 | 4.84 | 0.08 | | — | — | 0.4 | −0.5 | 10 | 10 |
| 9 | 2.45 | | 0.45 | 4.88 | 0.04 | | — | — | 0.49 | −10.5 | 0.5 | 10.5 |
| 10 | 2.45 | | 0.45 | 4.87 | 0.05 | | — | — | 0.47 | −8.5 | 1 | 8.5 |
| 11 | 2.4 | | 0.5 | 4.84 | 0.08 | | — | — | 0.4 | −4.3 | 6.5 | 6.5 |
| 12 | 2.4 | | 0.5 | 4.8 | 0.12 | | — | — | 0.42 | −2 | 9.5 | 9.5 |

TABLE 2

| Sample No. | Composition (atm/mol) Y (w) | Ca (q) | Gd (x) | Fe — | In (y) | V (z) | tan δ | Δ H (Oe) | Insertion loss (dB) | Δ f1: Low temp. to ambient temp. (MHz) | Δ f2: Ambient temp. to high temp. (MHz) | Δ f (MHz) |
|---|---|---|---|---|---|---|---|---|---|---|---|---|
| 13 | 2.62 | 0 | 0.4 | 4.94 | 0.04 | 0 | — | — | 0.42 | −5.5 | 5 | 5.5 |
| 14 | 2.62 | 0 | | 4.9 | 0.08 | 0 | — | — | 0.44 | −1.5 | 10.5 | 10.5 |
| 15 | 2.54 | 0.08 | | 4.9 | 0.04 | 0.04 | — | — | 0.43 | −6 | 3 | 6 |
| 16 | 2.54 | 0.08 | | 4.86 | 0.08 | 0.04 | — | — | 0.41 | −0.5 | 10.5 | 10.5 |
| 7 | 2.5 | 0.12 | | 4.88 | 0.04 | 0.06 | 0.0008 | 27 | 0.39 | −5 | 4 | 5 |
| 17 | 2.5 | 0.12 | | 4.84 | 0.08 | 0.06 | — | — | 0.40 | −0.5 | 10 | 10 |
| 18 | 2.46 | 0.16 | | 4.86 | 0.04 | 0.08 | — | — | 0.42 | −6.5 | 1.5 | 6.5 |
| 19 | 2.46 | 0.16 | | 4.82 | 0.08 | 0.08 | — | — | 0.43 | −7.5 | 7 | 7.5 |
| 20 | 2.49 | 0.13 | 0.41 | 4.87 | 0.04 | 0.07 | — | — | 0.40 | −4 | 5 | 5 |
| 21 * | 2.82 | 0.2 | 0 | 4.88 | 0 | 0.1 | 0.0006 | 28 | 0.37 | 12 | 12 | 24 |

From Tables 1 and 2, it can be understood that the magnetic material of the example according to the present invention has a dielectric loss (tan δ) and a magnetic resonance half line width (ΔH) equivalent to those of the comparative example (*).

Next, variations in center frequency will be described. In Tables 1 and 2, Δf1 is a value of variation in center frequency with a change in temperature from a low temperature (−35° C.) to an ambient temperature (25° C.), and Δf2 is a value of variations in center frequency with a change in temperature from an ambient temperature (25° C.) to a high temperature (85° C.). For the positive/negative of Δf1, the value is a positive number when the center frequency at an ambient temperature (25° C.) increases and the value is a negative value when the center frequency at an ambient temperature (25° C.) decreases on the basis of the center frequency at a low temperature (−35° C.). For the positive/negative of Δf2, the value is a positive number when the center frequency at a high temperature (85° C.) increases and the value is a negative value when the center frequency at a high temperature (85° C.) decreases on the basis of the center frequency at an ambient temperature (25° C.).

Referring to Table 2 and FIG. 4, for the isolator associated with sample No. 21, Δf1 is 12 MHz and Δf2 is 12 MHz, and thus the center frequency varies by 24 MHz (Δf) in the process of a change in temperature from a low temperature (−35° C.) to a high temperature (85° C.). On the other hand, referring to Table 1 and FIG. 5, it can be understood that for the isolator associated with sample No. 7, Δf1 is −5 MHz and Δf2 is 4 MHz, and thus Δf1 and Δf2 have different signs. This shows that the center frequency is shifted toward the lower frequency side over the range from a low temperature (−35° C.) to an ambient temperature (25° C.), and then shifted toward the higher frequency side over the range from an ambient temperature (25° C.) to a high temperature (85° C.), and as a result, the range of variations in center frequency in the process of a change in temperature from a low temperature (−35° C.) to a high temperature (85° C.) is restricted to a low value, i.e. 5 MHz. In Tables 1 and 2, Δf shows the difference between the minimum value of the center frequency and the maximum value of the center frequency when temperature changes from −35° C. to 85° C., and Δf is represented by an absolute value.

In the isolators associated with samples of Tables 1 and 2 other than samples No. 7 and No. 21, it can be understood that the center frequency is shifted toward the lower frequency side over the range from a low temperature (−35° C.) to an ambient temperature (25° C.), and then shifted toward the higher frequency side over the range from an ambient temperature (25° C.) to a high temperature (85° C.) as in sample No. 7. Δf of these isolators is 10.5 MHz at maximum, and is ½ or less of Δf of the isolator associated with sample No. 21.

The temperature characteristic of the center frequency for the isolator associated with sample No. 21 is about 0.02%/° C., whereas the temperature characteristic of the center frequency for the isolator associated with sample No. 7 is about 0.004%/° C., and the temperature characteristic of the center frequency for the isolator associated with sample No. 9 is about 0.01%/° C., from which it can be understood that the temperature characteristic of the center frequency for the isolator is improved by the present invention.

What is claimed is:

1. A circulator element comprising:

a garnet type ferrite material; and a permanent magnet for applying a direct-current magnetic field to said garnet type ferrite material, wherein S11 represents the saturation magnetization of said garnet type ferrite material at a temperature T1, S12 represents one at a temperature T2, and S13 represents one at a temperature T3; and S21 represents the saturation magnetization of said permanent magnet at a temperature T1, S22 represents one at a temperature T2, and S23 represents one at a temperature T3, where T1<T2<T3, and the saturation magnetizations S11, S12, S13, S21, S22 and S23 are relative values providing that the saturation magnetizations at the temperature T2 is 1, and wherein the relations |(S12−S11)/(T2−T1)|<|(S22−S21)/(T2−T1)| and |(S13−S12)/(T3−T2)|>|(S23−S22)/(T3−T2)| are satisfied;

wherein T1=−35° C., T2=25° C. and T3=85° C.

2. The circulator element according to claim 1, wherein the temperature characteristic of the center frequency at a temperature range between T1 and T3 is 0.01%/° C. or less.

3. The circulator element according to claim 1, wherein, where the center frequency at the temperature T1 is taken as a reference, and a frequency higher than said reference is a positive number and a frequency lower than said reference is a negative number, the center frequency at the temperature T2 is a negative number.

4. The circulator element according to claim 1, wherein, where the center frequency at the temperature T2 is taken as a reference, and a frequency higher than said reference is a positive number and a frequency lower than said reference is a negative number, the center frequency at the temperature T3 is a positive number.

5. The circulator element according to claim 1, wherein said permanent magnet has a composition expressed by the general formula (2): $(Sr_{1-\alpha}La_{\alpha})(Fe_{12-\beta}Co_{\beta})_{\gamma}O_{19}$, where $0.1 \leqq \alpha \leqq 0.4$, $0.1 \leqq \beta \leqq 0.4$, and $0.8 \leqq \gamma \leqq 1.1$.

6. The circulator element according to claim 1, wherein said circulator element is an isolator.

7. The circulator element according to claim 1, wherein, where the center frequency at the temperature T3 is taken as a reference, and a frequency higher than said reference is a positive number and a frequency lower than said reference is a negative number, one of the center frequencies at the temperatures T2 and T1 is a positive number and the other is a negative number.

8. The circulator element according to claim 7, wherein, the center frequency at the temperature T1 is a positive number and the center frequency at the temperature T2 is a negative number.

9. A circulator element according to claim 1 comprising:

a garnet type ferrite material; and a permanent magnet for applying a direct-current magnetic field to said garnet type ferrite material, wherein said circulator element includes:

a first region where the gradient in the temperature characteristic curve of saturation magnetization of said permanent magnet is larger than the gradient in the temperature characteristic curve of saturation magnetization of said garnet type ferrite material; and a second region where the gradient in the temperature characteristic curve of saturation magnetization of said permanent magnet is smaller than the gradient in the temperature characteristic curve of saturation magnetization of said garnet type ferrite material, wherein said second region is located in a temperature range higher than that of said first region.

10. The circulator element according to claim 9, wherein said first region and said second region meet near ambient temperatures.

11. The circulator element according to claim 1, wherein said garnet type ferrite material has a composition expressed by the general formula (1): $(Y_wGd_xCa_q)(Fe_{8-w-x-y-3z}In_yV_z)O_{12}$ (w, x, q, y and z each satisfy the following relations: $3.01 \leqq w+x+q \leqq 3.03$, $025 \leqq x \leqq 0.55$, $002 \leqq y \leqq 0.12$, $0<z \leqq 0.15$, and $1.8<q/z \leqq 2.0$).

12. The circulator element according to claim 11, wherein $0.3 \leqq x \leqq 0.5$.

13. The circulator element according to claim 11, wherein $0.03 \leqq y \leqq 0.10$.

14. The circulator element according to claim 11, wherein $0.02 \leqq z \leqq 0.12$.

15. A circulator element comprising:

a garnet type ferrite material having a composition expressed by the general formula (1): $(Y_wGd_xCa_q)(Fe_{8-w-x-y-3z}In_yV_z)O_{12}$ (w, x, q, y and z each satisfy the following relations: $3.01 \leqq w+x+q \leqq 3.03$, $0.25 \leqq x \leqq 0.55$, $0.02 \leqq y \leqq 0.12$, $0<z \leqq 0.15$, and $1.8<q/z \leqq 2.0$); and a permanent magnet having a composition expressed by the general formula (2): $(Sr_{1-\alpha}La_{\alpha})(Fe_{12-\beta}Co_{\beta})_{\gamma}O_{19}$, where $0.1 \leqq \alpha \leqq 0.4$, $0.1 \leqq \beta \leqq 0.4$, $0.8 \leqq \gamma \leqq 1.1$ and for applying a direct-current magnetic field to said garnet type ferrite material.

* * * * *